US008134444B2

(12) United States Patent
Horiuchi et al.

(10) Patent No.: US 8,134,444 B2
(45) Date of Patent: Mar. 13, 2012

(54) INDUCTOR AND MANUFACTURING METHOD THEREOF

(75) Inventors: Michio Horiuchi, Nagano (JP); Yukio Shimizu, Nagano (JP); Kazunari Sekigawa, Nagano (JP); Tsuyoshi Kobayashi, Nagano (JP)

(73) Assignee: Shinko Electronic Industries Co., Ltd., Nagano (JP)

( * ) Notice: Subject to any disclaimer, the term of this patent is extended or adjusted under 35 U.S.C. 154(b) by 29 days.

(21) Appl. No.: 12/895,915

(22) Filed: Oct. 1, 2010

(65) Prior Publication Data

US 2011/0080247 A1 Apr. 7, 2011

(30) Foreign Application Priority Data

Oct. 7, 2009 (JP) ..... 2009-233496

(51) Int. Cl.
*H01F 17/04* (2006.01)
*H01R 4/58* (2006.01)

(52) U.S. Cl. ..... 336/221; 336/200; 336/223; 336/232; 439/91; 439/66; 439/597

(58) Field of Classification Search ..... 336/200, 336/221, 223, 225, 232; 439/66, 67, 71, 439/91, 586, 591, 597
See application file for complete search history.

(56) References Cited

U.S. PATENT DOCUMENTS 5,435,580 A * 7/1995 Balbinot et al. ..... 280/11.214
5,451,770 A * 9/1995 Stewart ..... 250/221
5,477,933 A * 12/1995 Nguyen ..... 174/262
5,509,815 A * 4/1996 Jin et al. ..... 439/91
5,586,010 A * 12/1996 Murtuza et al. ..... 361/751
5,598,033 A * 1/1997 Behlen et al. ..... 257/686
5,690,270 A * 11/1997 Gore ..... 228/180.22
5,700,549 A * 12/1997 Garant et al. ..... 428/210
5,738,531 A * 4/1998 Beaman et al. ..... 439/71
5,800,184 A * 9/1998 Lopergolo et al. ..... 439/66
5,829,988 A * 11/1998 McMillan et al. ..... 439/70
5,880,890 A * 3/1999 Furuta ..... 359/626
2007/0040238 A1 2/2007 Yamasaki et al.

FOREIGN PATENT DOCUMENTS

JP 9-092538 4/1997
JP 2007-053311 3/2007

* cited by examiner

*Primary Examiner* — Anh Mai
*Assistant Examiner* — Joselito Baisa
(74) *Attorney, Agent, or Firm* — IPUSA, PLLC

(57) ABSTRACT

An inductor includes a core substrate including minute column-like electrical conductors extending between a front surface and a back surface of the core substrate. Each column-like electrical conductor is insulated from adjacent column-like electrical conductors by being surrounded by an insulating material. Insulation layers are formed on the front surface and the back surface of the core substrate, respectively. At least two connection electrical conductors extend through each of the insulation layers. Each connection electrical conductor is electrically connected to a plurality of the column-like electrical conductors. Wirings are formed on each of the insulation layers to connect said connection electrical conductors to each other electrically. The wirings, the connection electrical conductors and the column-like electrical conductors are connected to form a coil in a three-dimensional manner.

10 Claims, 8 Drawing Sheets

INDUCTOR AND MANUFACTURING METHOD THEREOF

CROSS-REFERENCE TO RELATED APPLICATIONS

This application is based upon and claims the benefit of priority of the prior Japanese Patent Application No. 2009-233496, filed on Oct. 7, 2009, the entire contents of which are incorporated herein by reference.

FIELD

The present invention relates to an inductor having a coil structure and a manufacturing method of such an inductor.

BACKGROUND

Many electronic circuits incorporated in a semiconductor package require an inductor as an electric component part forming the electronic circuit. One of the following methods may be used to incorporate a small inductor into a package substrate of a semiconductor package.

1) Forming a recessed portion in a package substrate and inserting a coil part, which is used as an inductor, into the recessed portion to embed the inductor in the package substrate.

2) Forming a spiral flat pattern by a flat wiring in a package substrate.

3) Forming a three-dimensional rectangular coil structure using via conductors and flat wirings in a package substrate.

According to the above-mentioned method 1), a surface mount chip coil, which is formed as a single part, is embedded in a package substrate. Thus, it is necessary to reserve a space for embedding the chip coil in the package substrate, which results in an increase in the size of the package substrate and miniaturization of the semiconductor package is limited.

According to the above-mentioned method 2), an inductor is formed in a package substrate in a manufacturing process of the package substrate by forming a flat coil using wirings in the package substrate. The package substrate having such a flat coil can be smaller than the package substrate having a chip coil embedded therein. However, because the flat coil on the package substrate is formed by spirally-arranged wirings, the flat coil cannot provide a large inductance.

According to the above-mentioned method 3), an inductor is formed in a package substrate in a manufacturing process of the package substrate by forming a three-dimensional coil using via conductors extending vertically in the package substrate and flat wirings extending horizontally in the package substrate. The three-dimensional coil formed in the package substrate can provide a larger inductance than the flat coil formed by spirally-arranged wirings. However, because a number of processes needed to form the three-dimensional coil is large, a manufacturing cost of the package substrate is increased.

Thus, there is suggested in Japanese Laid-Open Patent Application No. 2007-53311 a technique to form a small chip-type coil structure in which a three-dimensional coil is formed by using a substrate manufacturing technique such as the above-mentioned method (3) and embed the thus-formed chip-type coil structure in a package substrate. That is, a plurality of penetrating conductors are formed in a small-size insulating substrate, and a three-dimensional coil is formed by electrically connecting the penetrating conductors by wirings formed on front and back surfaces of the insulating substrate in order to form a small inductor as a single coil structure.

According to the coil structure disclosed in the above-mentioned patent document, many penetrating conductors such as via conductors must be formed in an insulating substrate. Thus, it is difficult to reduce the size of the coil structure because there is a limitation due to a density of the penetrating conductors, which can be formed in the insulating substrate. In order to adjust an inductance by changing a turn number of the coil, a number of penetrating conductors formed in the insulating substrate must be changed. Accordingly, in order to form a different inductor having a different inductance, a different insulating substrate must be fabricated.

Accordingly, it is desired to develop a technique to form a small-sized inductor structure for which inductance can be easily changed.

SUMMARY

It is a general object of the present invention to provide an inductor and a manufacturing method of an inductor in which the above-mentioned problems are eliminated.

There is provided according to one aspect of the present invention an inductor including: a core substrate including a plurality of minute column-like electrical conductors extending between a front surface and a back surface of the core substrate, each of the column-like electrical conductors being insulated from adjacent column-like electrical conductors by being surrounded by an insulating material; insulation layers formed on the front surface and the back surface of the core substrate, respectively; at least two connection electrical conductors extending through each of the insulation layers, each of said connection electrical conductors being electrically connected to a plurality of said column-like electrical conductors; and wirings formed on each of the insulation layers to connect the connection electrical conductors to each other electrically, wherein the wirings, the connection electrical conductors and the column-like electrical conductors are connected to form a coil in a three-dimensional manner.

There is provided according to another aspect of the present invention a manufacturing method of an inductor, including: preparing a core substrate in which a plurality of minute column-like electrical conductors extend in a direction of thickness; forming insulation layers on both sides of the core substrate; forming at least two connection electrical conductors each penetrating through each of the insulation layers so that each of the connection electrical conductors is connected to a plurality of the column-like electrical conductors; and forming wirings on each of the insulation layers to connect the connection electrical conductors, which are provided in the same one of the insulation layers, to each other.

The object and advantages of the embodiment will be realized and attained by means of the elements and combinations particularly pointed out in the appended claims.

It is to be understood that both the foregoing general description and the following detailed description are exemplary explanatory only and are not restrictive of the invention, as claimed.

DESCRIPTION OF EMBODIMENT(S)

Preferred embodiments of the present invention will be explained with reference to the accompanying drawings.

A description will be given first of an outline structure of an inductor according to an embodiment of the present invention.

Figure 1:
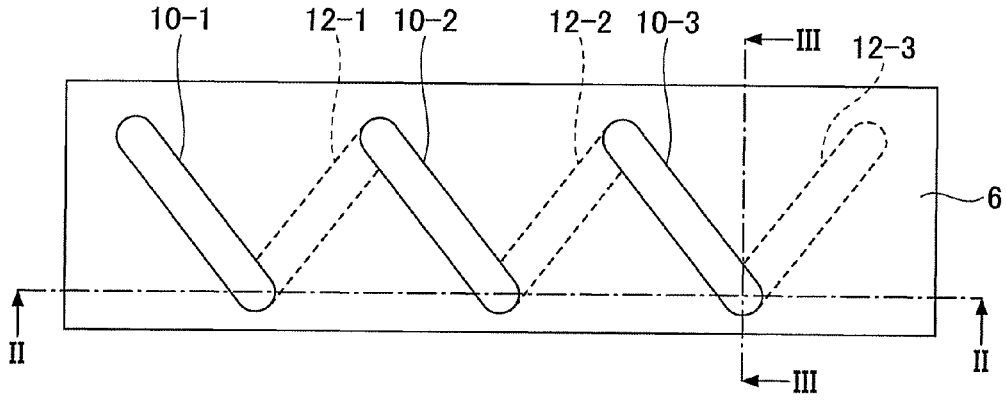
FIG. 1 is a cross-sectional view of an inductor according a first embodiment of the present invention.
Figure 2:
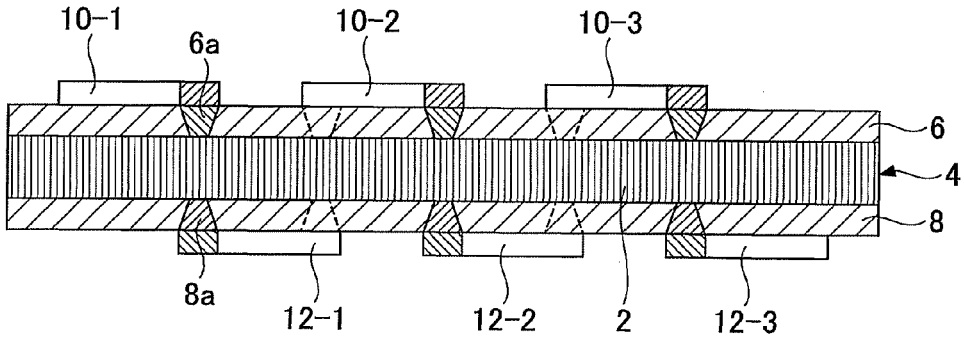
FIG. 2 is a cross-sectional view of the inductor taken along a line II-II of FIG. 1.
Figure 3:
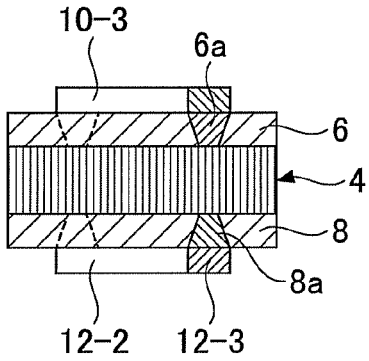
FIG. 3 is a cross-sectional view of the inductor taken along a line of FIG. 1.

FIG. 1 is a plan view of an inductor according to an embodiment of the present invention. FIG. 2 is a cross-sectional view of the inductor taken along a line II-II of FIG. 1. FIG. 3 is a cross-sectional view of the inductor taken along a line of FIG. 1.

The inductor according to the present embodiment includes a core substrate 4 containing many column-like electrical conductors 2, insulating layers 6 and 8 formed on a front surface and a back surface of the core substrate 4, and wirings 10-1, 10-2, 10-3, 12-1, 12-2 and 12-3 formed on the insulation layers 6 and 8, respectively. The wirings 10-1, 10-2 and 10-3 may be collectively referred to as wirings 10, and the wirings 12-1, 12-2 and 12-3 may be collectively referred to as wirings 12.

The core substrate 4 is a board in which a lot of the column-like electrical conductors 2, each of which is formed by an electrically-conductive material such as a metal, are formed. An insulating material forming the core substrate 4 may be an inorganic material or an organic material such as a resin as mentioned later. Although the thickness of the core substrate 4 varies according to a manufacture method thereof, the core substrate 4 may have a thickness of, for example, about 100 μm to about 500 μm.

Each of the column-like electrical conductors 2 is a thin metal wire or metal member having a diameter, for example, equal to or smaller than 20 μm, and is insulated by being surrounded by an insulating material. That is, each of many column-like electrical conductors 2 is isolated electrically in the core substrate 4. The density of the column-like electrical conductors 2 in the core substrate 4 may be as large as possible. Thus, it is desirable that the column-like electrical conductors 2 are arranged in a hexagonal close-packed structure while each of the column-like electrical conductors 2 is insulated by the insulating material. Moreover, in order to maximize the density of the column-like electrical conductors 2 in the core substrate 4, it is desirable to set the diameter of each column-like electrical conductor 2 to 20 μm or less. Although it may be difficult to form such a thin column-like electrical conductor 2, which has a diameter of 20 μm or less, by a conventional via extending in a direction of thickness of the substrate, such a thin column-like electrical conductor 2 can be formed easily according to a method mentioned later.

The insulation layers 6 and 8 are formed of an insulating material. A resin material such as, for example, an epoxy resin or a polyimide resin used for forming a build-up substrate may be used as the insulating material of the insulation layers 6 and 8. The thickness of each of the insulation layers 6 and 8 can be, for example, 20 μm to 50 μm.

Vias 6*a* and 8*a* are formed in the insulation layers 6 and 8. The vias 6*a* and 8*a* are connection electrical conductors, which penetrate and extend through the insulation layers 6 and 8, respectively. The vias 6*a* formed in the insulation layer 6, which is formed on the front surface of the core substrate 4, are connected to the column-like electrical conductors 2 of which ends are exposed on the front surface of the core substrate 4. Each of the vias 6*a* has a cross section considerably larger than a cross section of each of the column-like electrical conductors 2. An end of one of the vias 6*a* is connected to a plurality of column-like electrical conductors 2, and the other end is connected to a wiring 10 formed on the insulation layer 6. Additionally, the vias 8*a* formed in the insulation layer 8, which is formed on the back surface of the core substrate 4, are connected to the column-like electrical conductors 2 of which ends are exposed on the back surface of the core substrate 4. Each of the vias 8*a* has a cross section considerably larger than a cross section of each of the column-like electrical conductors 2. An end of one of the vias 8 is connected to a plurality of column-like conductors 2, and the other end is connected to a wiring 12 formed on the insulation layer 8.

Figure 4:
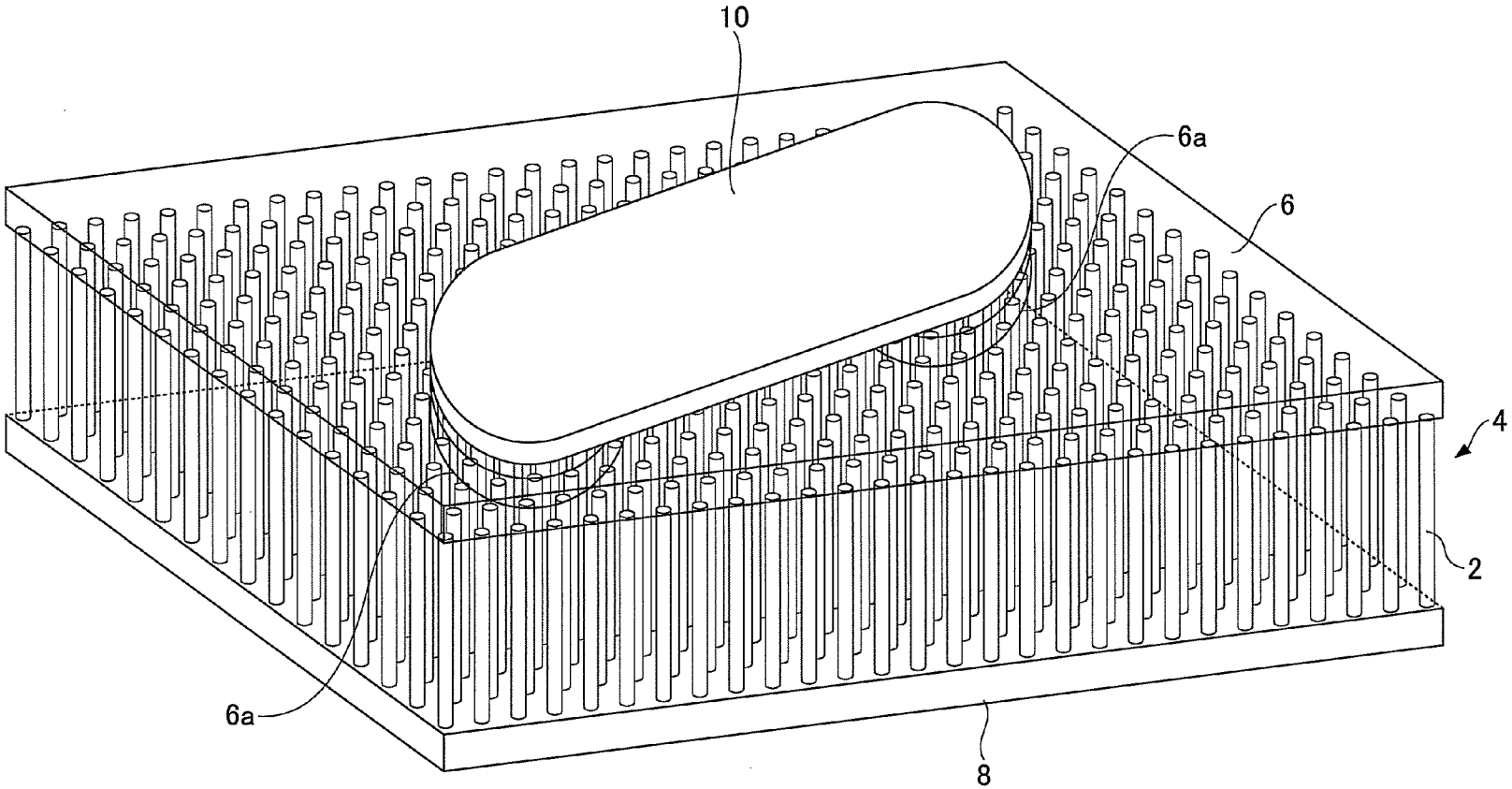
FIG. 4 is a perspective view illustrating a part of the inductor illustrated in FIG. 1.

FIG. 4 is a perspective view illustrating a part of the inductor mentioned above. In FIG. 4, an interior of the core substrate 4 is illustrated. Many column-like electrical conductors 2 are arranged in the core substrate 4, and circumferences of the column-like electrical conductors 2, that is, spaces between the column-like electrical conductors 2 are filled by an insulating material. Therefore, each of the column-like electrical conductors 2 is insulated by the insulating material and is isolated electrically.

The insulation layer 6 is formed on the front surface of the core substrate 4, and the wirings 10 are formed on the insulation layer 6. The vias 6*a*, which penetrate the insulation layer 6, are formed at positions corresponding to ends of the wirings 10. One end of each of the vias 6*a* is connected to the respective wirings 10, and the other end is connected to some of the column-like electrical conductors 2. Although it does not appear in FIG. 4, the insulation layer 8 is formed on the back surface of the core substrate 4, and the wirings 12 are formed on the insulation layer 8. The vias 8*a*, which penetrate the insulation layer 8, are formed at positions corresponding to ends of the wirings 12. One end of each of the vies 8*a* is connected to the respective wirings 12, and the other end is connected to some of the column-like electrical conductors 2.

Figure 5:
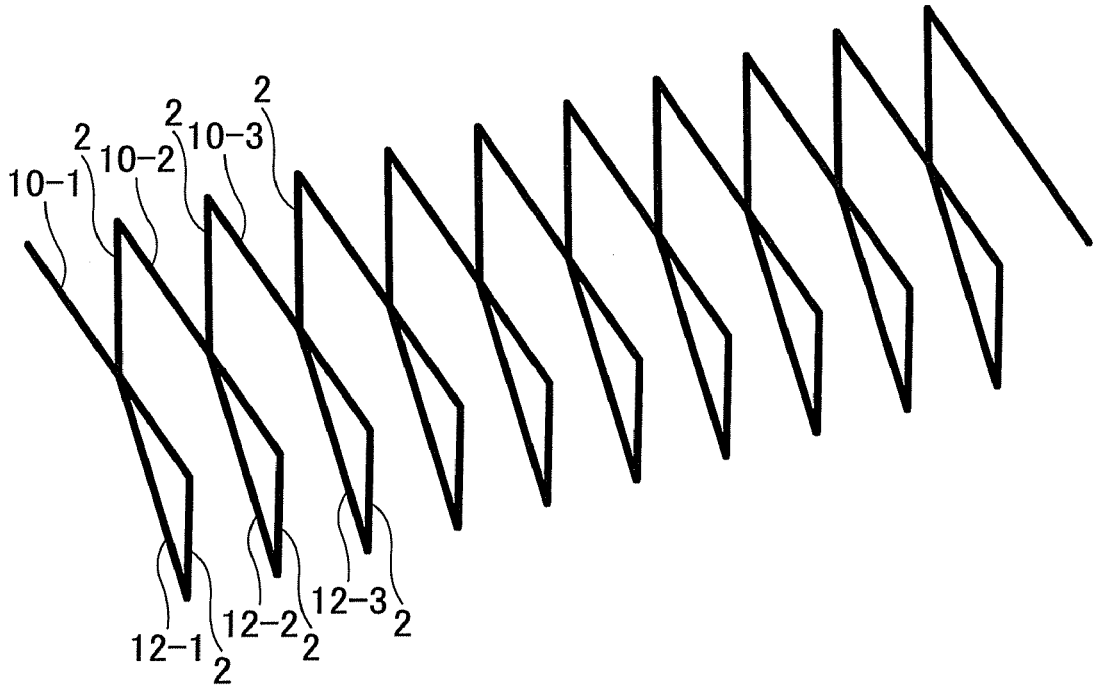
FIG. 5 is an illustration showing a shape of a coil formed in the inductor.

In the inductor having the above-mentioned structure, a rectangular coil is formed in a three-dimensional manner by the wirings 10, the vies 6*a*, the plurality of column-like electrical conductors 2, the vias 8*a* and the wirings 12. FIG. 5 is an illustration of a three-dimensional image of the coil. The end of the wiring 10-1 extending horizontally on the insulation layer 6 is connected to the via 6*a* extending perpendicularly in the insulation layer 6. The via 6*a* is connected to a plurality of the column-like electrical conductors 2, which extend perpendicularly in the core substrate 4. The plurality of column-like electrical conductors 2 are connected to the via 8*a* extending perpendicularly in the insulation layer 8. Then, the via 8*a* is connected to one end of the wiring 12-1 extending horizontally on the insulation layer 8. The other end of the wiring 12-1 is connected to the via 8*a* extending perpendicularly in the insulation layer 8. The via 8*a* is connected to a plurality of the column-like electrical conductors 2 extending perpendicularly in the core substrate 4. The plurality of column-like electrical conductors 2 are connected to the via 6*a* extending perpendicularly in the insulation layer 6. Then, the via 6*a* is connected to an end of the wiring 10-2 extending horizontally on the insulation layer 6. One turn of the tree-dimensional coil is formed by the above-mentioned structure.

In the inductor illustrated in FIG. 1 through FIG. 3, the electrical parts from the wiring 10-1 on the front side through the wiring 12-3 on the back side are connected to form the coil of three turns. However, the number of turns of the coil is not limited to three, and the number of turns of the coil may be increased as illustrated in FIG. 5 by increasing the number of the wirings 10 and 12 and the number of the vias 6*a* and 8*a*.

A description will be given below of a wiring method for forming a coil. A portion of the coil extending in a vertical or perpendicular direction corresponds to a part (some) of the many column-like electrical conductors 2 in the core substrate 4. That is, a plurality of the column-like electrical conductors 2, which are connected to the vias 6*a* and 8*a*, together serve as the portion of the coil extending in a perpendicular direction. The column-like electrical conductors 2, which are not connected to the vias 6*a* and 8*a*, do not contribute to the formation of the coil, and are in a state where each of the column-like electrical conductors 2 is merely isolated electrically in the core substrate 4. That is, only the column-like electrical conductors 2 at the positions where the vias 6*a* and 8*a* are formed are automatically selected as the portion of the coil extending in a perpendicular direction. Therefore, it is not necessary to previously form the portion of the coil extending in a perpendicular direction in the core substrate 4. The column-like electrical conductors 2 at arbitrary positions can be used as the portion of the coil extending in a perpendicular direction. Thereby, a degree of freedom in a design of the coil can be increased.

Figure 6:
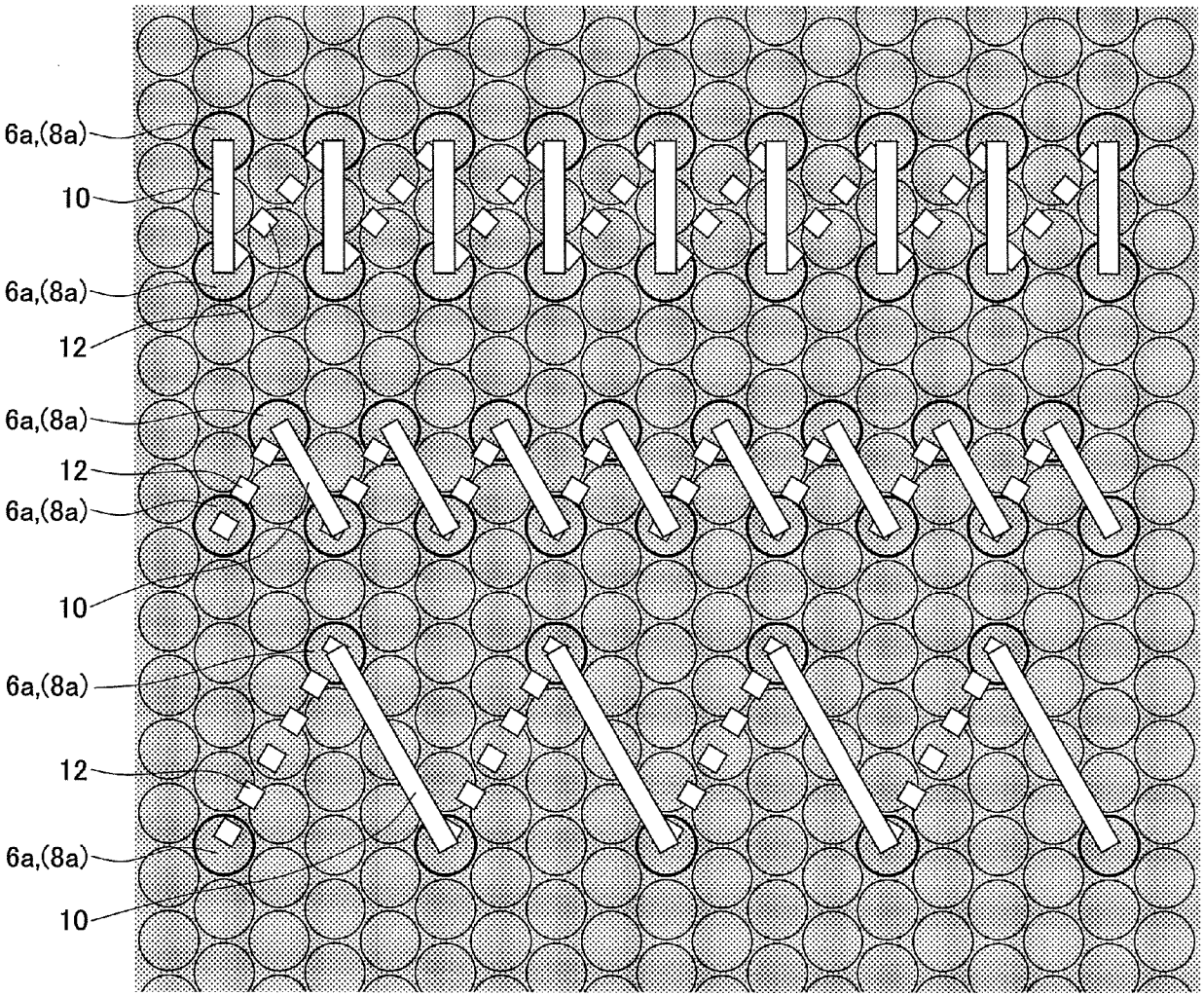
FIG. 6 is a plan view of a substrate having the same structure as a core substrate illustrated in FIG. 1.

FIG. 6 is a plane view of a substrate having the same structure as the core substrate 4. FIG. 6 illustrates an example of wiring for forming a coil. In FIG. 6, wirings on a front side of the substrate are indicated by elongated rectangular bars, and wirings on a back side of the substrate are indicated by consecutive small squares. Vias formed in the insulation layers are indicated by circles of bold line. Circles of normal line indicate areas where vias can be formed. A coil having an arbitrary form may be formed in a three-dimensional manner by selecting an arbitrary area from among the areas indicated by circles of normal line and forming vias in the insulation layers at the position corresponding to the arbitrarily selected area.

A description is given below of a manufacturing method of the above-mentioned core substrate 4. As mentioned above, the core substrate 4 is a board in which the column-like electrical conductors 2, which are formed by an electrically-conductive material such as a metal, are arranged in an insulating material. The diameter of each of the column-like electrical conductors 2 is very small and is, for example, 20 μm or less. It is necessary to fabricate a board in which a large number of such column-like electrical conductors 2 are arranged in the insulating material. It is desirable that the column-like electrical conductors 2 are arranged in a hexagonal close-packed structure when viewing the front surface of the core substrate 4. By arranging the column-like electrical conductors 2 in a hexagonal close-packed structure, the number of the column-like electrical conductors 2 arranged in a fixed area can be maximized.

Figure 7:
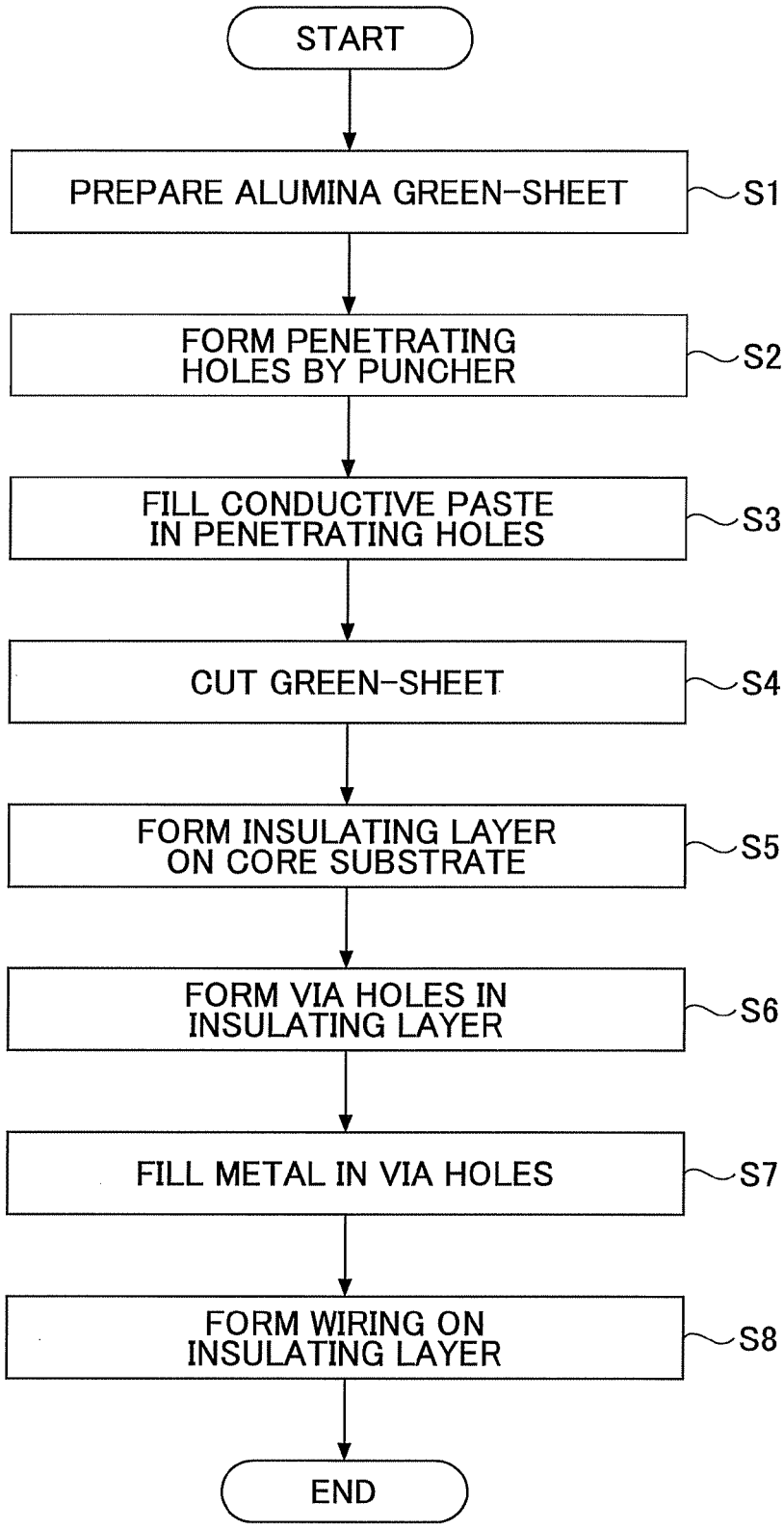
FIG. 7 is a flowchart of a manufacturing process of an inductor using a core substrate made of an alumina greensheet.

In order to fabricate the core substrate 4 of the above-mentioned structure, an alumina green-sheet (aluminum oxide: $Al_2O_3$) can be used as a base material of the core substrate 4. FIG. 7 is a flowchart of a manufacturing process to form an inductor by using the core substrate 4, which is fabricated using such an alumina green-sheet. First, an alumina green-sheet having a thickness of, for example, about 70 μm to 100 μm is prepared (step S1). Then, penetrating holes are formed in the entire alumina green-sheet by using a puncher or the like (step S2). It is desirable to arrange the penetrating holes in a hexagonal close-packed structure. Thereafter, a conductive paste such as silver (Ag) or copper (Cu) is filled into the penetrating holes (step S3). Then, the green-sheet is cut into the size of the core substrate 4 to complete the core substrate (step S4). Then, a resin material such as an epoxy resin, a polyimide resin, etc., is applied onto the front surface and the back surface of the core substrate 4 to form the insulation layers 6 and 8 (step S5). Then, via holes are formed at previously determined positions of the insulation layers 6 and 8 by using photolithography (step S6). Then, the vias 6*a* and 8*a* are formed by filling a metal such as copper (Cu) or the like by using a plating method (step S7). Finally, the wirings 10 and 12 of copper (Cu) or the like are formed on the insulation layers 6 and 8 to connect the vias 6*a* and 8*a* (step S8), and the inductor is completed.

Figure 8:
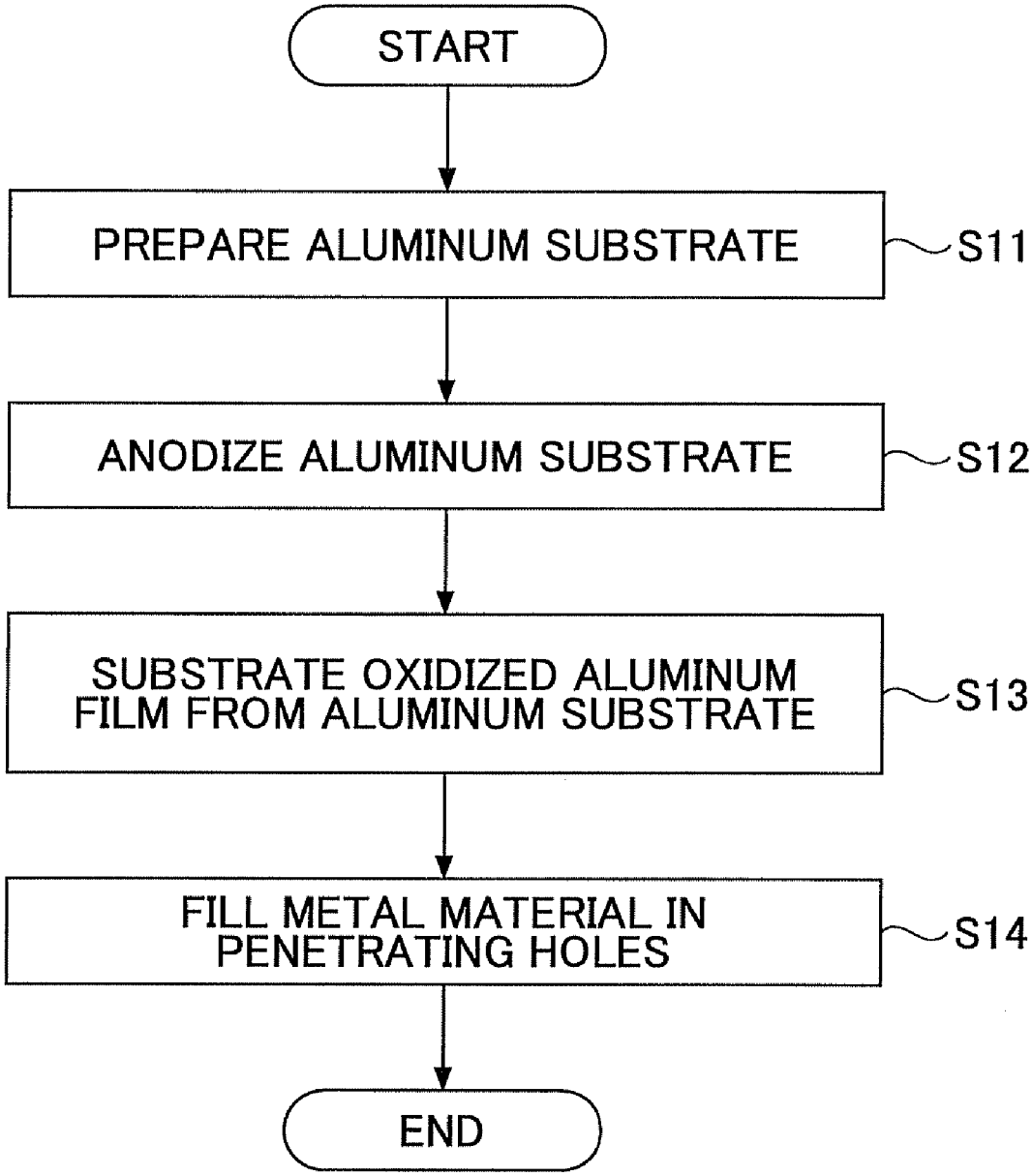
FIG. 8 is a flowchart of a process of forming a core substrate having many minute holes, which are formed by anodizing an aluminum plate.

According to the above-mentioned method, the density of the penetrating holes and the diameter of each of the penetrating holes are limited by processing by a puncher. However, if a method of forming minute holes by anodizing an aluminum plate is used, a core substrate having penetrating holes having a diameter much smaller than the penetrating holes formed by a puncher can be fabricated. FIG. 8 is a flowchart of a process of forming minute holes in a core substrate by anodizing an aluminum plate.

First, an aluminum (Al) plate having one surface insulation-coated is prepared (step S11). Then, after washing the surfaces of the aluminum plate, the aluminum plate is immersed into an electrolysis liquid to anodize the aluminum plate (step S12). It is desirable to use a sulfuric acid solution as the electrolysis liquid. The anodization is performed by supplying an electric current (applying a pulsed voltage) by using the aluminum plate as an anode and using a platinum (Pt) electrode, which is arranged opposite to the aluminum plate, as a cathode. According to the anodization, a porous aluminum oxide film is formed on the surfaces of the aluminum plate. The thus-formed aluminum oxide film has many holes each having a diameter of about 30 nm to 1 μm. The holes are arranged in a hexagonal close-packed structure. Then, the porous aluminum oxide film is separated from the aluminum plate by applying a voltage reverse to the voltage applied in the anodization (applying a voltage by using the aluminum plate as a cathode and using the platinum electrode as an anode) (step S13). The above-mentioned process is a process of fabricating a dielectric substrate having many minute penetrating holes, the dielectric substrate serving as a base material of the core substrate.

Subsequently, the column-like electrical conductors are formed by filling a metal material into the penetrating holes of the dielectric substrate (step S14). Although any electrically-conductive material may be used as the metal material to be filled, it is desirable to use copper (Cu) or nickel (Ni) from a view point that Cu or Ni can be easily filled using a plating method. That is, it is desirable to fill copper (Cu) or Nickel (Ni) into the penetrating holes according to a plating method. As an alternative method, an electrically-conductive paste such as a silver paste (Ag) or a copper (Cu) paste may be filed in the penetrating holes. Further, if necessary, both surfaces of the dielectric substrate, of which penetrating holes have been filled by a metal, may be flattened by mechanical polishing or chemical mechanical polishing in order to expose opposite ends of each of the column-like electrical conductors on the both surfaces of the dielectric substrate. According to the above-mentioned process, the core substrate is completed. After the core substrate is completed, the process of steps S5 through S8 illustrated in FIG. 7 is performed to form the inductor using the core substrate.

Figure 9:
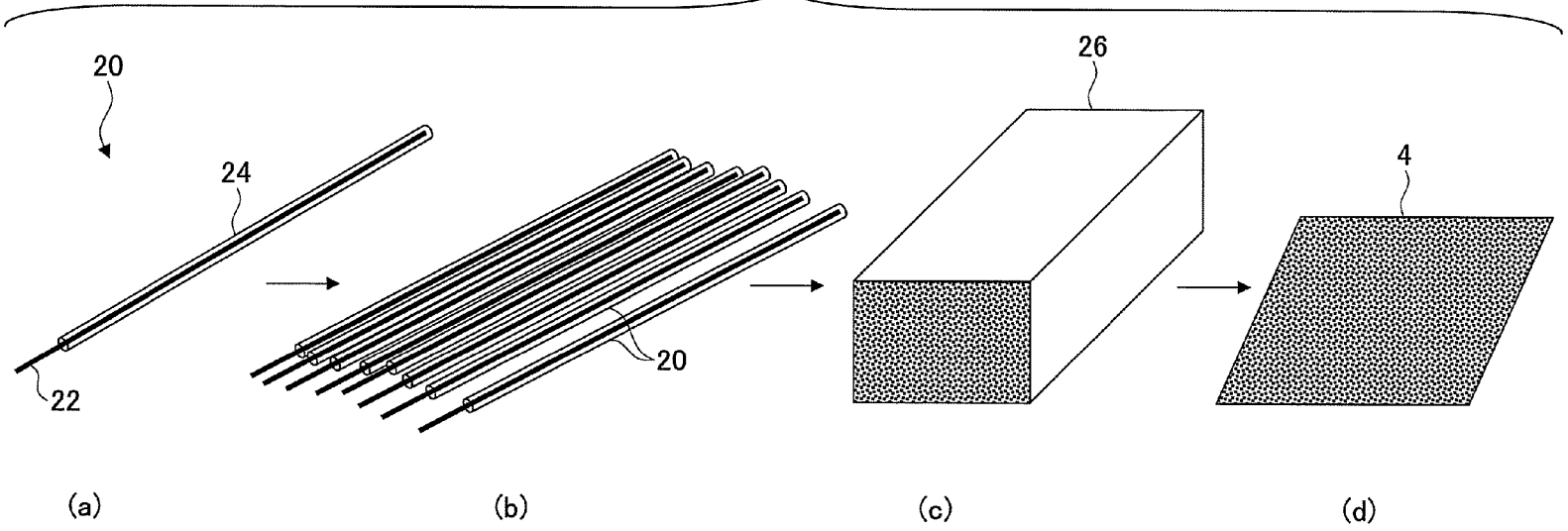
FIG. 9 is a flowchart of a process of forming a core substrate by bundling and combining a plurality of resin-coated metal wires into a single piece.

There is another method of fabricating a core substrate. FIG. 9 is a flowchart of a process of fabricating a core substrate by bundling and combining a plurality of resin coated metal wires.

First, many coated wires 20 are prepared. Each of the coated wires 20 includes a metal wire 22 such as a copper wire, which is coated by a coating resin 24 such as a half-curable resin or the like. The coated wires 20 are bundled and the coating resin 24 is cured to combine the coated wires 20 into a single coated-wire block 26. Then, the coated-wire block 26 is cut with a predetermined thickness to form the core substrate 4 having therein many metal wires 22 extending in a direction of thickness in the coating resin 24. After the core substrate 24 is completed, the process of steps S5 through S8 illustrated in FIG. 7 is performed to form the inductor using the core substrate.

According to the above-mentioned embodiment, the coil structure can be in a small size because a density of the column-like electrical conductors arranged in the core substrate can be very high. Moreover, because only the column-like electrical conductors, which are connected to the connection electrical conductors, serve as a part of the coil, a shape of the coil can be changed easily by changing a position of the connection electrical conductors. Thus, an inductance of the coil can be varied easily.

All examples and conditional language recited herein are intended for pedagogical purposes to aid the reader in understanding the principles of the invention and the concepts contributed by the inventor to furthering the art, and are to be construed a being without limitation to such specifically recited examples and conditions, nor does the organization of such examples in the specification relates to a showing of the superiority and inferiority of the invention. Although the embodiment(s) of the present invention(s) has(have) been described in detail, it should be understood that the various changes, substitutions, and alterations could be made hereto without departing from the spirit and scope of the invention.

What is claimed is:

1. An inductor, comprising:

a core substrate including a plurality of minute column-like electrical conductors extending between a front surface and a back surface of the core substrate, each of the column-like electrical conductors being insulated from adjacent column-like electrical conductors by being surrounded by an insulating material;

insulation layers formed on said front surface and said back surface of said core substrate, respectively;

at least two connection electrical conductors extending through each of said insulation layers, each of said connection electrical conductors being electrically connected to a plurality of said column-like electrical conductors; and wirings formed on each of said insulation layers to connect said connection electrical conductors to each other electrically, wherein said wirings, said connection electrical conductors and said column-like electrical conductors are connected to form a coil in a three-dimensional manner.

2. The inductor as claimed in claim 1, wherein a diameter of each of said column-like electrical conductors is equal to or smaller than 20 μm, and said column-like electrical conductors are arranged in said core substrate to form a hexagonal close-packed structure.

3. The inductor as claimed in claim 1, wherein each of said connection electrical conductors has a cross section which encompasses a plurality of said column-like electrical conductors.

4. The inductor as claimed in claim 1, wherein said core substrate includes column-like electrical conductors, each of which is electrically isolated and is connected to none of said connection electrical conductors.

5. The inductor as claimed in claim 1, wherein said core substrate has a structure in which said column-like electrical conductors are arranged close to each other in an inorganic insulating material.

6. The inductor as claimed in claim 5, wherein said inorganic insulating material is an anodic oxide of aluminum, and said column-like electrical conductors are formed by an electrically-conductive material being filled in many minute holes formed in the anodic oxide of aluminum.

7. The inductor as claimed in claim 1, wherein said core substrate has a structure in which a plurality of metal wires serving as said column-like electrical conductors are arranged close to each other in a resin material.

8. A manufacturing method of an inductor, comprising:

preparing a core substrate in which a plurality of minute column-like electrical conductors extend in a direction of thickness;

forming insulation layers on both sides of said core substrate;

forming at least two connection electrical conductors each penetrating through each of said insulation layers so that each of the connection electrical conductors is connected to a plurality of said column-like electrical conductors; and forming wirings on each of said insulation layers to connect the connection electrical conductors, which are provided in the same one of said insulation layers, to each other.

9. The manufacturing method of an inductor as claimed in claim 8, including:

forming said core substrate by forming a plurality of penetrating holes in an insulating substrate by a puncher and filling an electrically-conductive material in the penetrating holes.

10. The manufacturing method of an inductor as claimed in claim 8, including:

forming said core substrate by forming a porous aluminum oxide film by anodizing an aluminum substrate and filling an electrically-conductive material in penetrating holes of the aluminum oxide film.

* * * * *